US005687450A

United States Patent [19]

Stein et al.

[11] Patent Number: 5,687,450

[45] Date of Patent: Nov. 18, 1997

[54] MACHINE, SUCH AS A VACUUM CLEANER, WHICH EXHAUSTS A CLEAN GAS, WHICH MACHINE HAS A PROTECTIVE BUMPER

[75] Inventors: Klaus Stein; Heinz Kaulig, both of Velbert, Germany

[73] Assignee: Stein & Co. GmbH, Velbert, Germany

[21] Appl. No.: 525,493

[22] Filed: Sep. 8, 1995

[30] Foreign Application Priority Data

Sep. 10, 1994 [DE] Germany ..... 44 32 231.3
Oct. 15, 1994 [DE] Germany ..... 44 36 935.2

[51] Int. Cl.[6] ..... A47L 9/10

[52] U.S. Cl. ..... 15/325; 15/347

[58] Field of Search ..... 15/325

[56] References Cited

U.S. PATENT DOCUMENTS 3,364,513 1/1968 Brisman ..... 15/325
4,797,968 1/1989 Wenzlick et al. ..... 15/325 X
4,831,682 5/1989 White .
4,876,762 10/1989 Foster ..... 15/325 X
4,993,105 2/1991 Buchtel et al. .

FOREIGN PATENT DOCUMENTS 3042894 5/1982 Germany .

*Primary Examiner*—Chris K. Moore
*Attorney, Agent, or Firm*—Nils H. Ljungman and Associates

[57] ABSTRACT

On floor cleaning machines, and on vacuum cleaners in particular, there is a protective bumper to provide protection for the machine against impacts and to protect furniture and other objects. The bumper extends along at least a portion of a side wall in the circumferential direction of the protective bumper. The protective bumper is provided with a supporting body which is made of an elastic material or an elastically compressible material, and is provided in the vicinity of its dimension, or side, facing away from the side wall with a cover which is made of a flexible material. The protective bumper provides a large exhaust surface area, which large exhaust surface area is used for the discharge of the exhaust air. As a result of the exhaust of the air over a large area, the invention achieves both a good reduction of acoustical emissions and a good filtering action.

10 Claims, 6 Drawing Sheets

MACHINE, SUCH AS A VACUUM CLEANER, WHICH EXHAUSTS A CLEAN GAS, WHICH MACHINE HAS A PROTECTIVE BUMPER

BACKGROUND OF THE INVENTION

1. Field of the Invention

The present invention generally relates to a machine, such as a portable floor cleaning machine, in particular a vacuum cleaner, with an exhaust filter.

In addition, the present invention generally relates to a machine, such as that described above, having a protective bumper to damp impacts and to protect furniture and other objects, in which the bumper extends in the circumferential direction as a projecting part at least along a portion of the side walls of the unit.

2. Background Information

On vacuum cleaners, it is conventional to transport the air which has been sucked in, after it passes through the dust trap and the filter, through an exhaust duct to a number of housing slots which are located next to one another. As the air is being discharged from the slots in the housing, it reaches considerable flow velocities. On account of the relatively high concentration of the air stream, a significant amount of noise is also produced, in addition to the components of the noise which are transmitted from the vicinity of the vacuum cleaner motor. After the air stream exits the slots in the housing, it is also possible for dust in the vicinity of the machine to be blown away, as well as lightweight objects. The air stream can also be unpleasant for persons who are in the room being cleaned.

For reasons relating to flow technology, it is advantageous to make the exhaust duct and the exit points in the vicinity of the vacuum cleaner housing as large as possible, in order to achieve the lowest possible exhaust resistance. But in contradiction to these requirements, the acoustical emissions generally must also be reduced to the lowest level possible, which can only be achieved by the use of a relatively high flow resistance. These contradictory requirements have essentially not been satisfactorily resolved by any known machines.

On floor cleaning machines, such as vacuum cleaners, carpet cleaners, or other cleaning devices, one problem is that when the machine is in operation, it must often be moved close to and alongside furniture and other objects. Above all, on machines which are pulled along behind the user, it is not always possible to prevent impacts and contact between the machine and furniture or other stationary objects. To prevent damage to the machine and/or to furniture and other stationary objects, the machines are therefore frequently equipped with bumpers which prevent direct contact between the housing of the machine and the furniture or other objects. Such protective bumpers can be made of rubber, for example.

These known protective bumpers tend to be characterized by only small deflections upon impact, and it has been found that they tend not to meet the requirements of the situation. The machine frequently leaves streaks or scratches on furniture and fixtures where the strip of rubber has rubbed against them. On account of the relatively rigid construction of the floor cleaning machines, moreover, damage can be caused to very sensitive objects which have soft surfaces.

As disclosed in German Laid Open Patent Application No. 30 42 984 and U.S. Pat. No. 4,993,103, vacuum cleaners are known in which the air exhaust is integrated into a protective bumper strip. U.S. Pat. No. 4,831,682 also discloses that protective bumper strips can be made of textile material.

OBJECT OF THE INVENTION

An object of the present invention is, therefore, to construct a machine of the type described hereinabove which achieves both a low flow resistance as well as sufficient reduction of acoustical emissions.

Another object of the present invention is to improve machines, with protective bumpers of the type described hereinabove, which reduce the damage to stationary furniture and fixtures, and which do not leave marks, and also to provide mechanical protection for the machine.

SUMMARY OF THE INVENTION

The present invention teaches that the above objects can be accomplished, in accordance with at least one preferred embodiment, by a bumper which extends along at least a portion of the side walls of the machine in the circumferential direction as a projecting part, and includes a supporting body which is made of an elastic material, and is provided, in the vicinity of its surface facing away from the side wall of the machine, with an air-permeable cover. This air-permeable cover is preferably made of a flexible material, whereby in the vicinity of its dimension or side of the supporting body facing away from the cover, there is a conduit or connection for the air to be exhausted, and the supporting body preferably connects the conduit or connection to the cover by means of at least one flow path.

As a result of the use of an exhaust filter designed as a protective bumper, a large filter cross section is essentially available, and therefore a low flow resistance to the exhaust. Moreover, a large exhaust surface area is formed, so that essentially only low flow velocities occur in the vicinity of the exhaust. The level of exhaust noise is correspondingly low. Furthermore, as a result of the design of the protective bumper, the air is exhausted in a diffuse manner, so that almost no noticeable flow intensity occurs in the immediate vicinity of the protective bumper.

The low flow velocity in the vicinity of the filter also has the advantage that there is essentially a higher degree of separation of the particles suspended in the exhaust air. On account of the relatively large filter volume, therefore, the system, in accordance with the present invention, achieves a very long and useful filter life.

Alternatively, the invention teaches that the supporting body for the bumper can be made of an elastically compressible material.

As a result of the realization of the supporting body from an elastic or elastically compressible material, the bumper can be provided with a very flexible consistency. This flexible consistency essentially guarantees that, even if the bumper comes into contact with sensitive materials, the bumper will give flexibly and prevent damage to the objects and to the machine. The covering of the supporting body on one hand essentially prevents damage to the supporting body, and on the other hand provides greater flexibility of design in terms of the realization of the surface of the bumper. This design flexibility can be used to select physically suitable characteristics of the covering, and to provide, for example, a very soft surface. It also permits considerable design flexibility with regard to the color and decoration.

By realizing the bumper with a cover which can be removed from the supporting body without having to disassemble the machine housing, it becomes possible in a simple manner to change or replace the cover, as a function of the aesthetic desires of the individual user.

Moreover, such a change or replacement can be made easily when the cover gets dirty or when it becomes worn after long use.

A particularly soft surface in the area of the cover can be obtained if the cover is made of a textile material.

A high degree of flexibility in the vicinity of the supporting body can be achieved if the supporting body is made of foam.

In one embodiment which is particularly favorable from the point of view of manufacturing technology, for the realization of locators for a mounting of the protective bumper, the bumper can be located in the vicinity of the transition from the top part of the housing to the bottom part of the housing.

The protective bumper can be mounted in a manner which takes into account the mechanical loads likely to be experienced if, in the vicinity of the side walls, there are projections which extend in the circumferential direction. These projections run essentially parallel to one another and form grooves into which the cover can be introduced and fastened by means of its peripheral areas.

To grip the cover in a simple manner, the invention teaches that the projections can extend in a direction which faces away from the interior of the housing.

To eliminate mechanical loads and stresses in the vicinity of the mounting of the protective bumper, the invention teaches that the projections can alternatively extend toward the interior of the housing.

The security of the fastening of the protective bumper can be increased if the cover, in its peripheral areas, has reinforcement elements which can be introduced into corresponding grooves.

It becomes essentially easier to manufacture the reinforcement element and the connection between the reinforcement element and the cover in a single operating process if the reinforcement elements are made of plastic and/or cardboard, at least certain areas.

To reduce the flow resistance in the vicinity of the supporting body, the invention teaches that, starting from an exhaust duct located in the vicinity of the interior and leading into the vicinity of the supporting body, there can be an air duct which runs through the supporting body and extends into the vicinity of the cover.

A large surface area for the discharge of the exhaust is also achieved because flow grooves to guide the air flow are located in the vicinity of a surface of the supporting body which faces the cover.

In particular when substances with a relatively low air permeability are used as the material for the supporting body, it is appropriate if, starting from the mouth of the exhaust duct in the vicinity of the supporting body, bypass grooves are formed in a lateral area of the supporting body to guide the air and extend into the vicinity of the cover.

The flexibility in terms of the design and construction of the cover can essentially be increased if the cover consists of at least two layers.

To further improve the filter characteristics, the invention teaches that at least one of the layers can be realized in the form of a microfilter.

The invention further teaches that the above objects can be accomplished by a bumper which includes a supporting body which is made of an elastic material, and by a supporting body which is provided, in the vicinity of its dimension or side facing away from the side wall, with a cover which is made of a flexible material.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

One aspect of the invention resides broadly in a vacuum cleaner for movement along a floor, said vacuum cleaner comprising a housing having suction producing means; said housing comprising a top portion, a bottom portion, and a plurality of side walls extending between said top portion and said bottom portion; means for permitting movement of said housing along a floor; means, extending from said housing, for conveying suction externally of said housing; said means for conveying suction being in fluid communication with said suction producing means; a protective bumper for protecting said housing from contact with external objects, said protective bumper being disposed on said housing; said housing comprising at least one connection for directing exhaust air towards said protective bumper; said protective bumper comprising a porous structure being disposed to accept exhaust air from said at least one connection and direct the exhaust air out from said housing; and said porous structure having pores, said pores generally being sized to filter particles from the exhaust air.

BRIEF DESCRIPTION OF THE DRAWINGS

Preferred embodiments of the present invention are illustrated shematically in the accompanying drawings, wherein.

DESCRIPTION OF THE PREFERRED EMBODIMENTS

Figure 1:
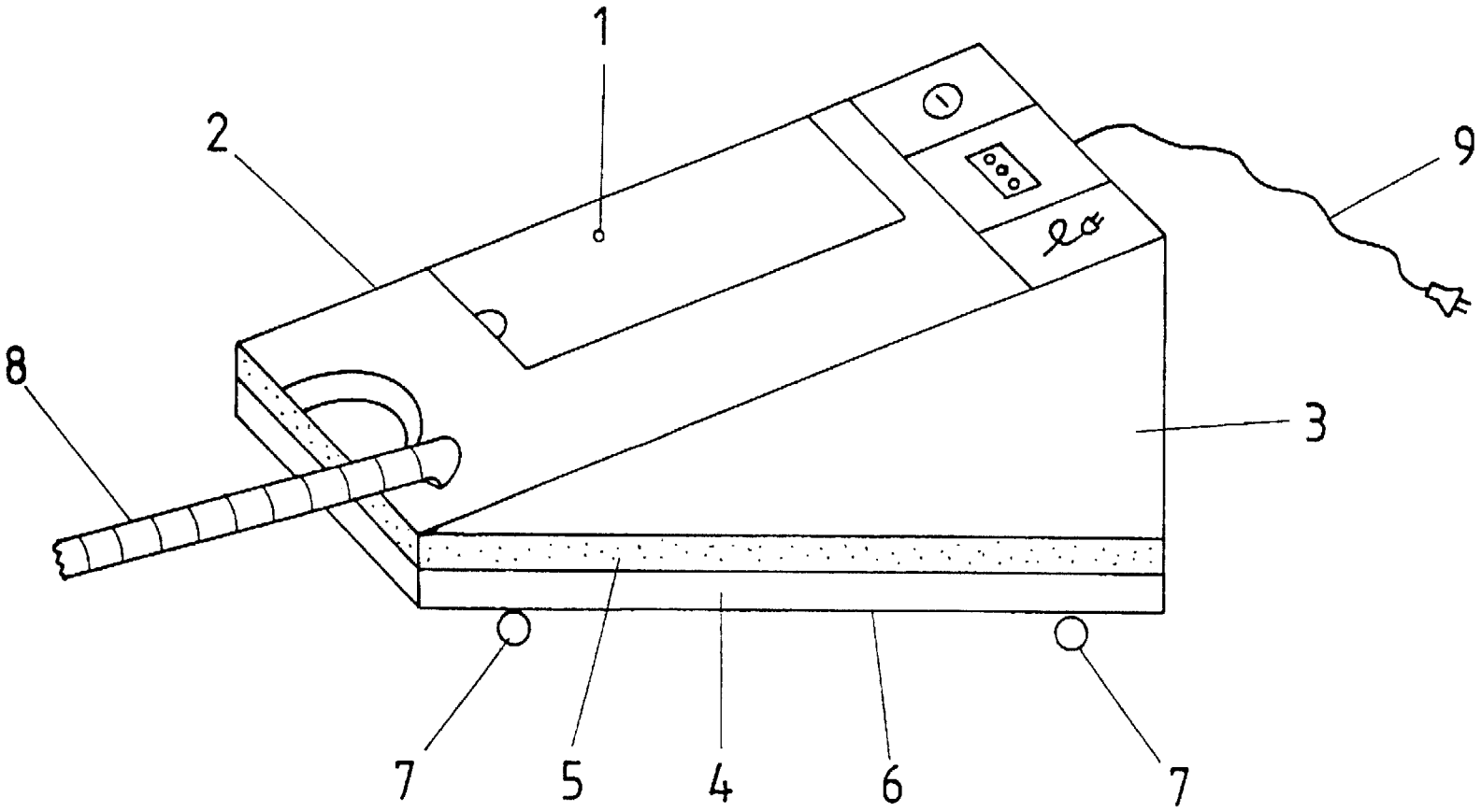
FIG. 1 is essentially the same as FIG. 1A.
Figure 1A:
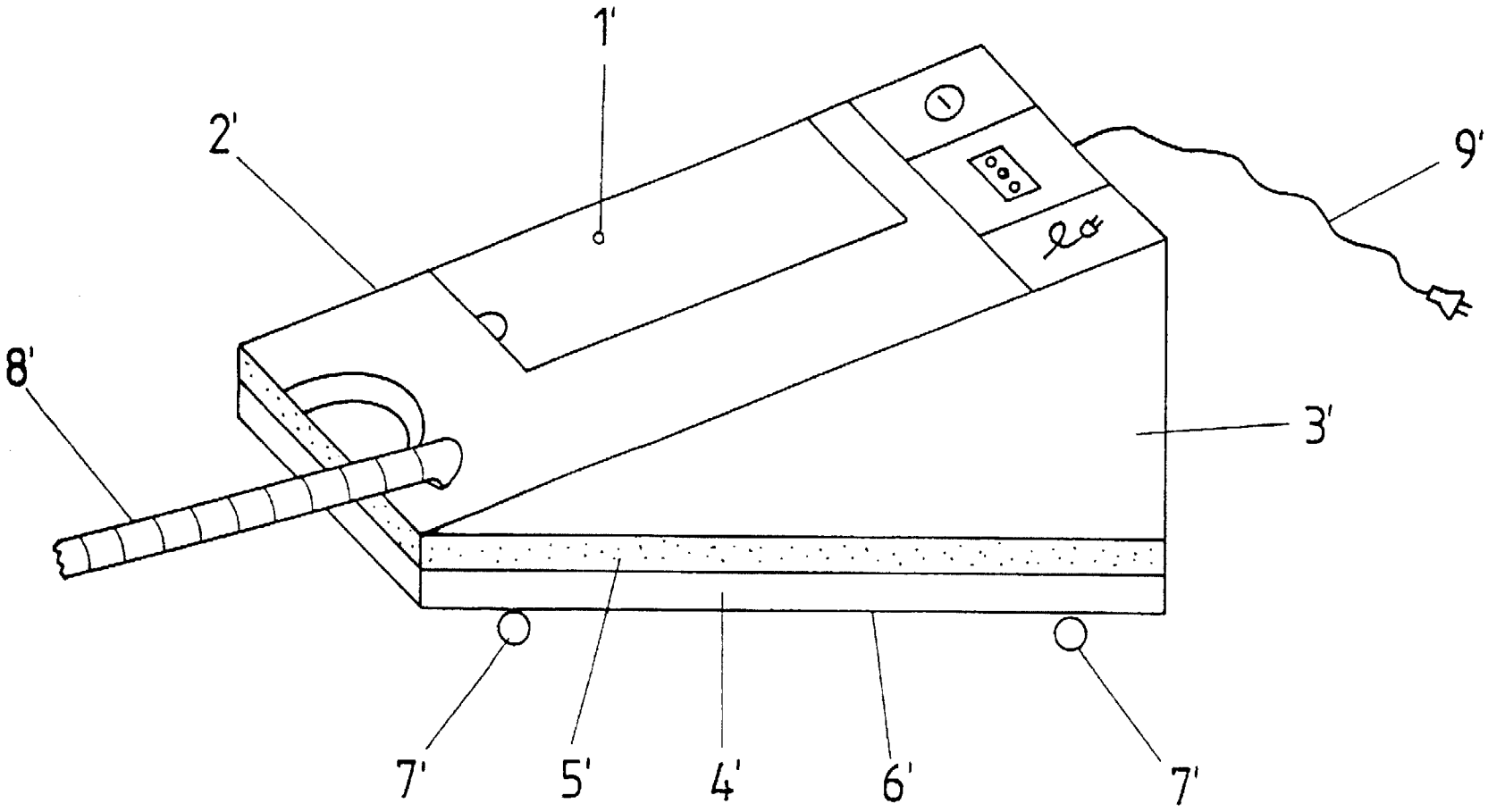
FIG. 1A shows a view in perspective of a vacuum cleaner which is equipped with a protective bumper.

The illustration in FIG. 1A shows a vacuum cleaner 1' which can essentially include a housing 2' which has a top part 3' and a bottom part 4', which top part 3' and bottom part 4' are preferably connected to one another in the vicinity of a protective bumper 5'. Rollers 7' can be located on the underside 6' of the vacuum cleaner 1'. There can also be a suction hose 8', and the electrical connection is preferably made by means of a cable 9'.

Figure 1B:
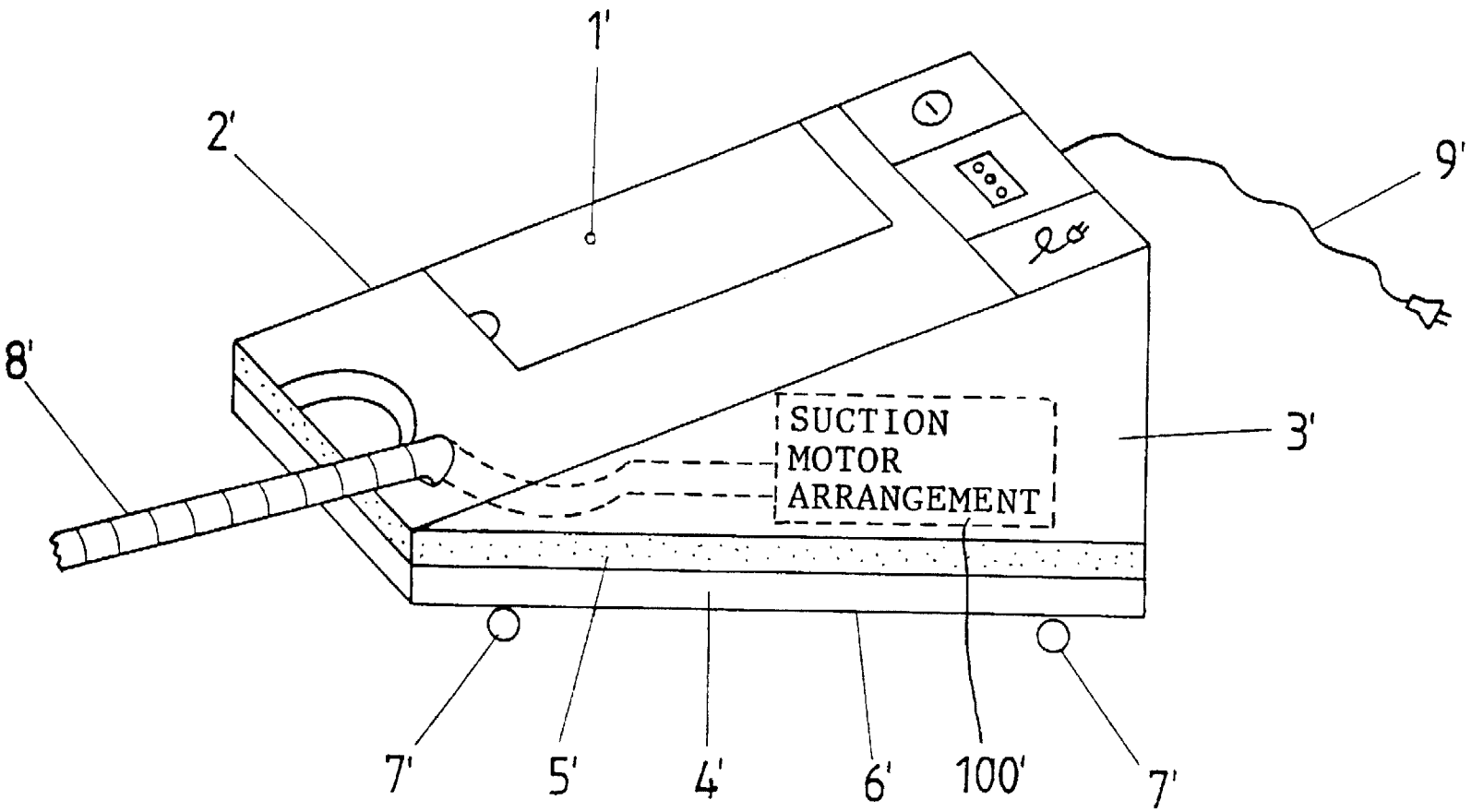
FIG. 1B depicts a view in perspective of a vacuum cleaner and a suction motor arrangement.

In the cross section shown in FIG. 1B, the suction motor arrangement 100' can be located within the housing 2' of the vacuum cleaner 1'.

Figure 1D:
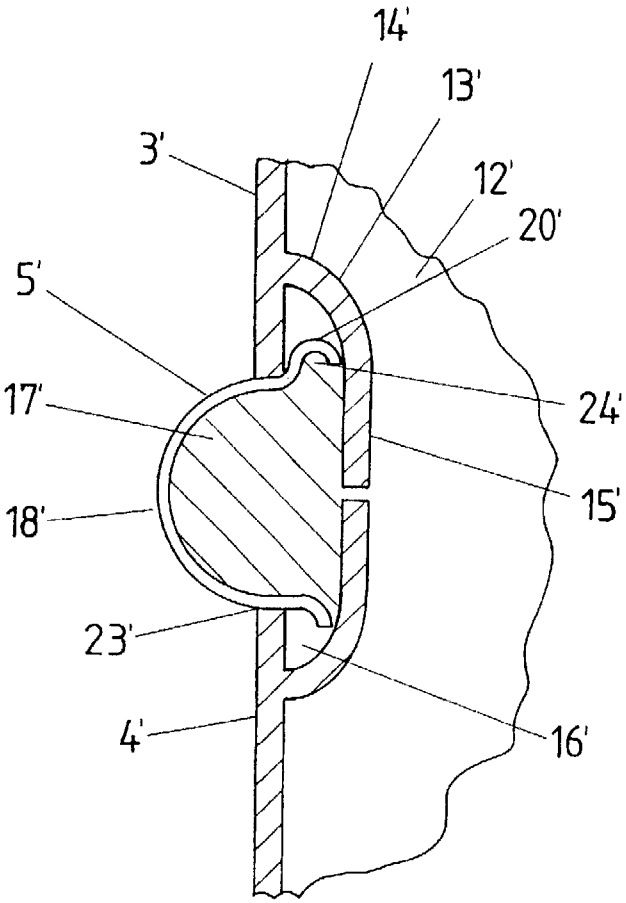
FIG. 1D depicts an embodiment of a modified system for fastening the bumper.
Figure 1C:
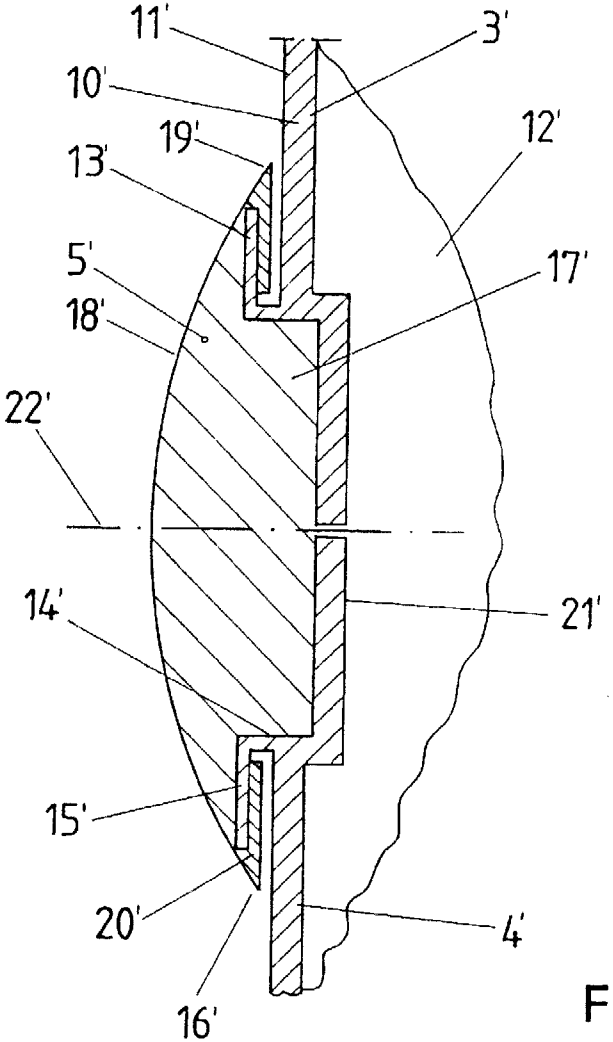
FIG. 1C shows a cross section through a side wall of the floor cleaning machine and an attached protective bumper.

In the cross section shown in FIG. 1C, the protective bumper 5' can be located in the area of the transition between the top part 3' and the bottom part 4' of the housing 2'. The top part 3' and the bottom part 4' can form a side wall 10' in the vicinity of the protective bumper 5'. In the vicinity of one outer side 11' of the side wall 10', which outer side 11' is located facing essentially away from the inside 12' of the vacuum cleaner 1', an angle-shaped projection 13' can extend both in the vicinity of the top part 3' and also in the vicinity of the bottom part 4'. The projection 13' can preferably include a right-angle leg 14', which right-angle leg 14' can be connected to the side wall 10' and can rise essentially perpendicularly from the side wall 10', and a mounting leg 15', which mounting leg 15' can start at the right-angle leg 14' and extend essentially parallel to the side wall 10'. Between the mounting leg 15' and the side wall 10' there can preferably be a groove 16'.

The protective bumper 5' can preferably be embodied by a supporting body 17' which can preferably be made of an elastically compressible material. Foam rubber, for example, can be used as the material for the supporting body 17'. Alternatively, an elastic material such as molded soft rubber could be used for the supporting body 17'. In the vicinity of the dimension or side of the supporting body 17' facing away from the side wall 10', the supporting body 17' can be provided with a cover 18', which cover 18' can preferably be made out of a flexible material. In the vicinity of the edges 19', the protective bumper 5' can have reinforcement elements 20', which reinforcement elements 20' can have an essentially plate-shaped design, and can be made of cardboard or plastic. The reinforcement elements 20' can be introduced into the groove 16' and thereby essentially grip the cover 18' and preferably hold the cover 18' in place over the supporting body 17'.

Alternatively, the reinforcement elements 20' could be made of a combination of cardboard and plastic.

In an additional embodiment of the reinforcement elements 20' of the protective bumper 5' as depicted in FIG. 1C, the reinforcement elements 20' can be formed from a shape-retaining polymer material which would be easily moldable.

In accordance with at least one preferred embodiment of the present invention, the aforementioned supportive body 17' can additionally be made of an open-cell elastic foamed plastic or a compressible polymeric foam. An additional realization of the supporting body 17' is possible by making the supporting body 17' of a carbonaceous moldable material, which carbonaceous material preferably has excellent compressive elasticity.

In the embodiment illustrated in FIG. 1C, there is a depression 21' formed in the vicinity of the side wall 10' to hold the supporting body 17'. This measure essentially increases the available elasticity of the supporting body 17'. Starting from the depression 21', the supporting body 17' can extend beyond the mounting leg 15'. Essentially, the particular purpose of this measure would be to make certain that the supporting body 17' also covers the mounting leg 15' in the vicinity of the dimension of the supporting body 17' facing away from the groove 16'. The supporting body 17' thereby essentially can have an approximately T-shaped contour, whereby the base or main leg of the T-contour may be relatively broad.

In an additional advantageous realization, the supporting body 17', in the vicinity of the dimension of the supporting body 17' facing away from the side wall 10', can be provided with an essentially rounded contour. On one hand, this may facilitate the gripping of the cover 18', and on the other hand, the supporting body 17' can project farthest from the side wall 10' in the vicinity of a center line 22', which projection of the supporting body 17' can preferably increase the flexibility of the protective bumper 5' in the event of contact with a piece of furniture or another object. The essentially rounded contour of the supporting body 17' can give the supporting body 17' an essentially mushroom-shaped contour.

The reinforcement element 20' can be connected to the cover 18' by sewing or gluing, for example. Basically, it can also be conceivable to realize the reinforcement element 20' in the form of a bead, cover, or wrapper of the cover 18'. The depression 21' and the projections 13' preferably run all the way around the vacuum cleaner 1'. The projections 13' thereby may run essentially parallel to one another and to the depression 21'. To facilitate manufacturing operations, the projections 13' can be manufactured simultaneously with the upper part 3' and the bottom part 4' as an injection molded part.

The reinforcement element 20' could also be connected to the cover 18' by a heat-treatment method.

In an additional realization of the reinforcement element 20', the reinforcement element 20' could also be formed as an integral part of the cover 18' of the protective bumper 5'. This realization could be appropriate if the cover 18' was made of a heat-treatable material so that the material of the cover 18' could be formed by a heat-treatment method into a shape which would fit into the groove 16'.

In the embodiment illustrated in FIG. 1D, the depression 21' may be designed so that the depression 21' is delimited by the projections 13', which projections 13' can extend into the interior 12'. At this point, the right-angle leg 14' can make an essentially rounded transition into the mounting leg 15'. The right-angle leg 14' can also be recessed in relation to an entrance opening 23' of the depression 21', which entrance opening 23' can preferably be delimited by the side wall 10'. The groove 16' can thereby be formed between the side wall 10' and a portion of the mounting leg 15'. In this embodiment, the supporting body 17' can preferably be realized so that there can be an elastically deformable expanded portion 24' in the vicinity of the groove 16'. The supporting body 17' can thereby be gripped in the vicinity of the groove 16' and can fix the cover 18' in place. On account of the reinforcement element 20', a sufficiently strong anchoring of the cover 18' can also be essentially guaranteed in this embodiment.

The illustration in FIG. 1 shows a vacuum cleaner 1, which vacuum cleaner 1 may consist of a housing 2 which can preferably have a top part 3 and a bottom part 4 which top part 3 and bottom part 4 can be connected to one another in the vicinity of a protective bumper 5. Rollers 7 can be located on the underside 6 of the vacuum cleaner 1. There can also be a suction hose 8, and the electrical connection may be made by means of a cable 9.

Figure 2:
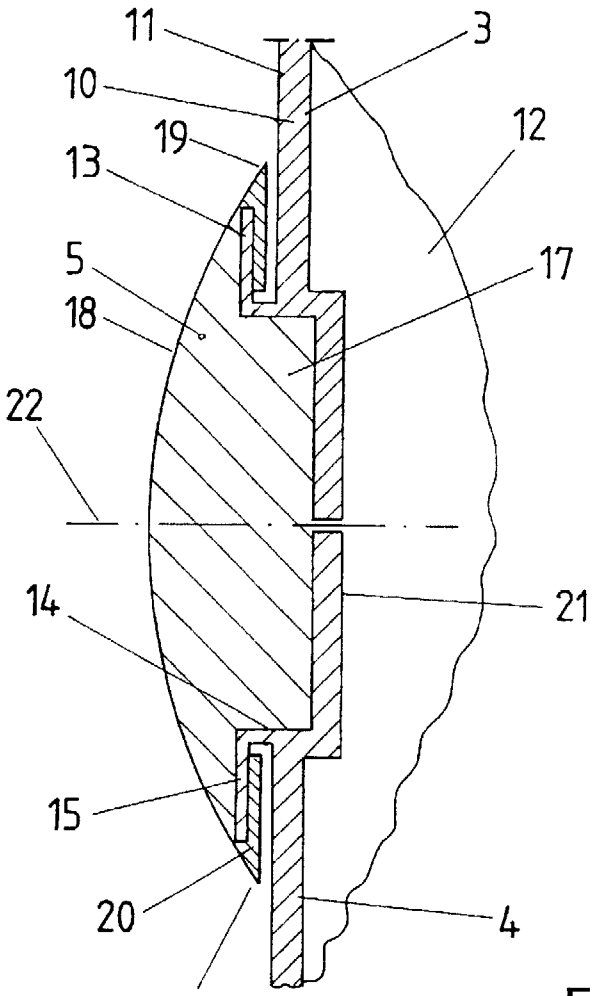
FIG. 2 is essentially the same as FIG. 1C, and additionally depicts an exhaust duct.

In the cross section shown in FIG. 2, the protective bumper 5 can be located in the area of the transition between the top part 3 and the bottom part 4 of the housing 2. The top part 3 and the bottom part 4 can form a side wall 10 in the vicinity of the protective bumper 5. In the vicinity of one outer side 11 of the side wall 10, which can be located facing essentially away from the inside 12 of the vacuum cleaner 1, an angle-shaped projection 13 can extend both in the vicinity of the top part 3 and also in the vicinity of the bottom part 4. The projection 13 could consist of a right-angle leg 14, which right-angle leg 14 could be connected to the side wall 10 and would rise essentially perpendicularly from the side wall 10, and a mounting leg 15 which mounting leg 15 could start at the right-angle leg 14 and extend essentially parallel to the side wall 10. Between the mounting leg 15 and the side wall 10, there is preferably a groove 16.

The protective bumper 5 could be embodied by a supporting body 17 which supporting body 17 would preferably be made of an elastically compressible material. Foam rubber, for example, could be used as the material for the supporting body 17. Alternatively, an elastic material such as molded soft rubber could be used for the supporting body 17. In the vicinity of the dimension or side of the supporting body 17 facing away from the side wall 10, the supporting body 17 could be provided with a cover 18 which cover 18 can be made of a flexible material. In the vicinity of the edges 19, the protective bumper 5 could have reinforcement elements 20 which reinforcement elements 20 may have an essentially plate-shaped design, and could be made of cardboard or plastic. The reinforcement elements 20 would be introduced into the groove 16 and thereby grip the cover 18 and hold it in place over the supporting body 17.

Alternatively, the reinforcement elements 20 could also be formed of a combination of cardboard and a plastic material.

As an additional realization, the reinforcement elements 20, could be made of a moldable, shape-retaining polymer material.

In the embodiment illustrated in FIG. 2, there can preferably be a depression 21 formed in the vicinity of the side wall 10 to hold the supporting body 17. This measure can essentially increase the available elasticity of the supporting body 17. Starting from the depression 21, the supporting body 17 can extend beyond the mounting leg 15 with a center line 22. The particular purpose of this measure can be to essentially make certain that the supporting body 17 also covers the mounting leg 15 in the vicinity of the dimension of the mounting leg 15 facing away from the groove 16. The supporting body 17 thereby can have an approximately T-shaped contour, whereby the base or main leg of the T-contour can be relatively broad.

Adjacent to the depression 21 for the supporting body 17 there can be a feed or delivery element 25, which feed or delivery element 25 can delimit an exhaust duct 26, which exhaust duct 26 may be routed into the vicinity of the reverse side of the supporting body 17 facing the interior 12. Exhaust air to be exhausted through the exhaust duct 26 can be transported into the vicinity of the supporting body 17. The feed element 25 can be realized in a tubular shape, and in a relatively limited space can guide exhaust air into the vicinity of the support body 17. However, it can also be possible to select a more extended shape for the feed element 25 in the longitudinal direction, to provide an essentially larger delivery surface area for the supporting body 17. It is also conceivable to locate a distributor element, e.g. a ring line, in the circumferential direction inside the interior 12, which distributor element can be connected to the reverse side of the supporting body 17 by means of a multiplicity of feed elements 25.

In accordance with at least one preferred embodiment of the present invention, the aforementioned distributor element, or "ring line", could be embodied by an extended conduit within the interior 12 of the vacuum cleaner 1 that parallels the inner periphery of the vacuum cleaner 1 and feeds exhaust air to individual feed elements 25.

In an additional advantageous realization, the supporting body 17, in the vicinity of the dimension of the supporting body 17 facing away from the side wall 10, can be provided with an essentially rounded contour. On one hand, this can facilitate the gripping of the cover 18, and on the other hand, the supporting body 17 can project farthest from the side wall 10 in the vicinity of a center line 22, which projection of the supporting body 17 can increase the flexibility of the protective bumper in the event of contact with a piece of furniture or another object. The essentially rounded contour of the projection of the supporting body 17 would give the supporting body 17 an essentially mushroom-shaped contour.

The reinforcement element 20 may be connected to the cover 18 by sewing or gluing, for example. Basically, it is also conceivable to realize the reinforcement element 20 in the form of a bead, cover, or wrapper of the cover 18. The depression 21 and the projections 13 can preferably run all the way around the vacuum cleaner 1. The projections 13 thereby can run essentially parallel to one another and to the depression 21. To facilitate manufacturing operations, the projections 13 can be manufactured simultaneously with the upper part 3 and the bottom part 4 as an injection molded part.

The reinforcement element 20 could also be connected to the cover 18 by a heat-treatment method.

Additionally, if the cover 18 is made of a material which is heat-treatable, heat-treatment could be used to form the reinforcement element 20 as an integral part of the cover 18.

Preferably, cover 18 is made of what may be termed an "air-permeable" material. The term "air-permeable" can be taken to include materials through which air can preferably pass without the air being subject to high resistance. It is additionally preferable, with this arrangement, that the "air-permeable" material be able to filter small particles such as dust from the air when the air is passing through the pores and interstices of the air-permeable material. Examples of such materials may be found in the U.S. patents so designated at the close of the instant specification.

Figure 3:
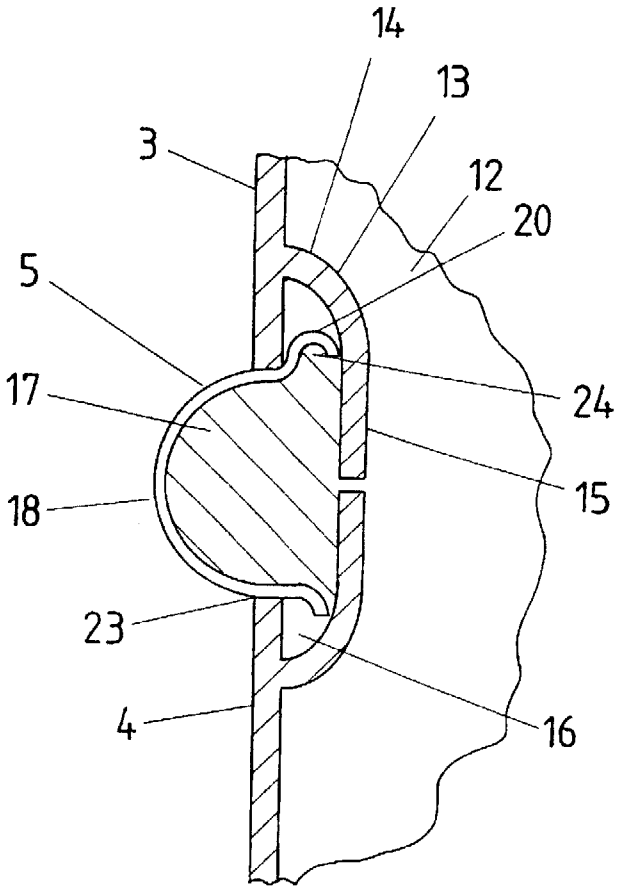
FIG. 3 shows a modified system for fastening the bumper.

In the embodiment illustrated in FIG. 3, the depression 21 can be designed so that the depression 21 would be delimited by the projections 13, which projections 13 can extend into the interior 12. At this point, the right-angle leg 14 can make an essentially rounded transition into the mounting leg 15. The right-angle leg 14 could also be recessed in relation to an entrance opening 23 of the depression 21, which entrance opening 23 would be delimited by the side wall 10. The groove 16 can thereby be formed between the side wall 10 and a portion of the mounting leg 15. In this embodiment, the supporting body 17 can preferably be realized so that there can be an elastically deformable expanded portion 24 in the vicinity of the groove 16. The supporting body 17 would thereby be gripped in the vicinity of the groove 17 and essentially fix the cover 18 in place. On account of the reinforcement element 20, a sufficiently strong anchoring of the cover 18 can also essentially be guaranteed in this embodiment.

Figure 4:
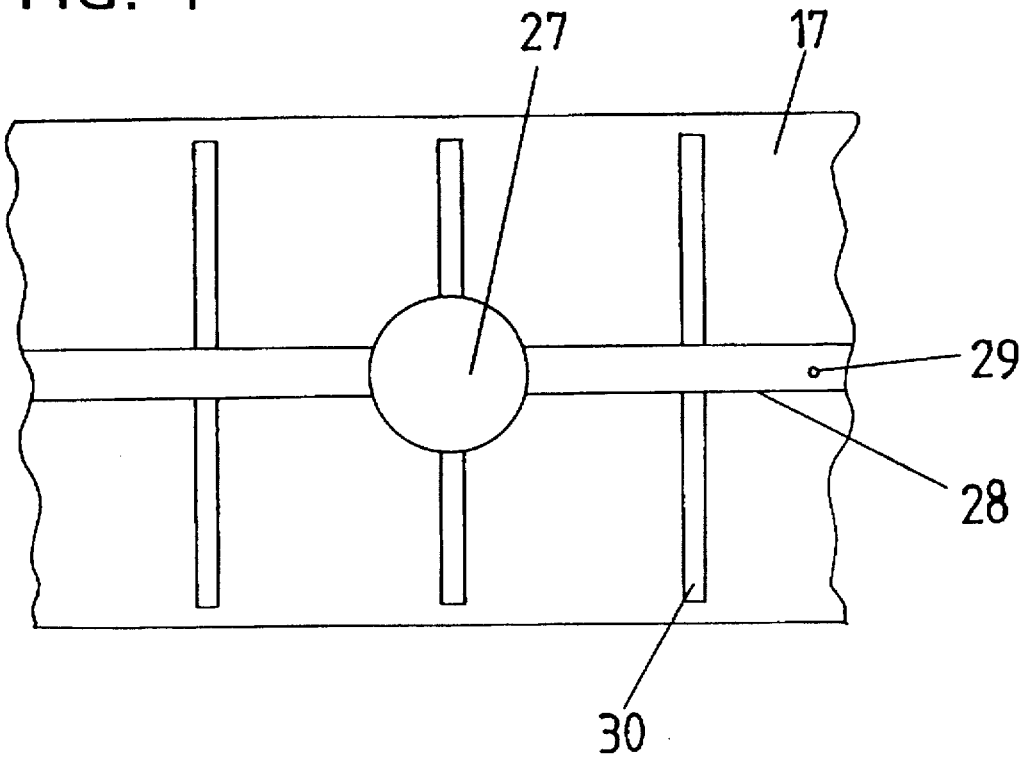
FIG. 4 shows a partial plan view of the supporting body of a bumper with a passage opening for the exhaust air, and a duct structure for the distribution of the air in the vicinity of the surface of the supporting body facing a cover.

FIG. 4 shows a surface of the supporting body 17 facing away from the interior 12, which surface of the supporting body 17, when installed, would support the cover 18. An air duct 27 can extend through the supporting body 17, and in the vicinity of the dimension, side, or surface of air duct 27 facing the interior of the supporting body 17, air duct 27 can empty, join, or open into the exhaust duct 26 (see FIGS. 2 and 3). In the vicinity of the surface of the supporting body 17, there can preferably be flow grooves 28, which flow grooves 28 preferably promote the distribution of the air underneath the cover 18. For example, it is possible to use deeper circumferential grooves 29 along with shallower grooves 30 oriented at right angles to circumferential grooves 29, wherein shallower grooves 30 can empty, join, or open into circumferential grooves 29. Basically, it can also be conceivable, instead of the flow grooves 28, to use complementary flow webs, which flow webs could essentially support the cover 18 at a specified distance from the normal surface of the supporting body 17. Such an arrangement would also promote the distribution of the air underneath the cover 18.

In accordance with the above mentioned embodiment of FIG. 4, the exhaust duct 26 preferably ducts air from the interior 12 of the vacuum cleaner 1 to the air duct 27, which air duct 27 can essentially be deepest below the surface of the supporting body 17. Air duct 27, in turn, preferably joins into circumferential groove 29 and empties exhaust air into circumferential groove 29. Circumferential groove 29 preferably runs essentially parallel to the longitudinal axis of the bumper 5, and circumferential groove 29 is preferably disposed at an essentially intermediate depth from the surface of the supporting body 17. The shallower grooves 30 are preferably oriented essentially at right angles to circumferential grooves 29. The shallower grooves 30 preferably duct exhaust air from circumferential grooves 29 to the vicinity of the surface of the supporting body 17 beneath the cover 18. In other words, exhaust air from the interior 12 of the vacuum cleaner 1 is preferably exhausted through exhaust duct 26 into air duct 27; air is then preferably exhausted into circumferential grooves 29; from circumferential grooves 29, air can be exhausted into shallower grooves 30; shallower grooves 30, in turn, can preferably duct the exhaust air into the vicinity of the surface of the supporting body 17.

In accordance with at least one preferred embodiment of the present invention, the aforementioned flow webs can preferably be formed as a flow web mat. The flow web mat could include meltblown, randomly entangled fibers having a relatively high strength to eliminate crushing of the flow web mat. Preferably, the flow web mat will cause no air pressure drop in the air being exhausted. Additionally, in this embodiment, electrically charged fibers can be randomly dispersed within the flow web mat.

In accordance with at least one preferred embodiment of the present invention, the aforementioned exhaust duct 26 can connect with air duct 27 by means of a simple alignment of one end of exhaust duct 26 and air duct 27.

Additionally, the connection of air duct 27 to exhaust duct 26 can be made by a quick-connect fitting, which connection can be accomplished by the exposed end of air duct 27 or exhaust duct 26 having a groove formed on the exterior wall of the ductwork and the adjoining air duct 27 or exhaust duct 26 provided with bearings on the inner wall of the duct, in order that the bearings easily fit into the groove formed in the exterior wall of the ductwork of the adjoining air duct 27 or exhaust duct 26.

In accordance with another preferred embodiment of the present invention, connecting exhaust duct 26 to air duct 27 can be accomplished by flaring the connecting end of air duct 27 and tapering the connecting end of exhaust duct 26, so that the tapered end of exhaust duct 26 fits into the flared connecting end of the ductwork of air duct 27.

In accordance with another preferred embodiment of the present invention, the connection of exhaust duct 26 to air duct 27 can be accomplished by fitting together smooth cylindrical shaped ends of the ducts for a slip fit. In this embodiment, the connecting ends of exhaust duct 26 and air duct 27 would have a cylindrical shape; the exterior diameter of the connecting end of exhaust duct 26 can preferably be made essentially the same size as, or somewhat smaller than, the interior diameter of air duct 27 so that the connecting end of the ductwork of exhaust duct 26 fits snugly into the connecting end of air duct 27.

Of course, other strategies for connecting air duct 27 with exhaust duct 26, with essentially the same results, are conceivable within the scope of the present invention.

Figure 5:
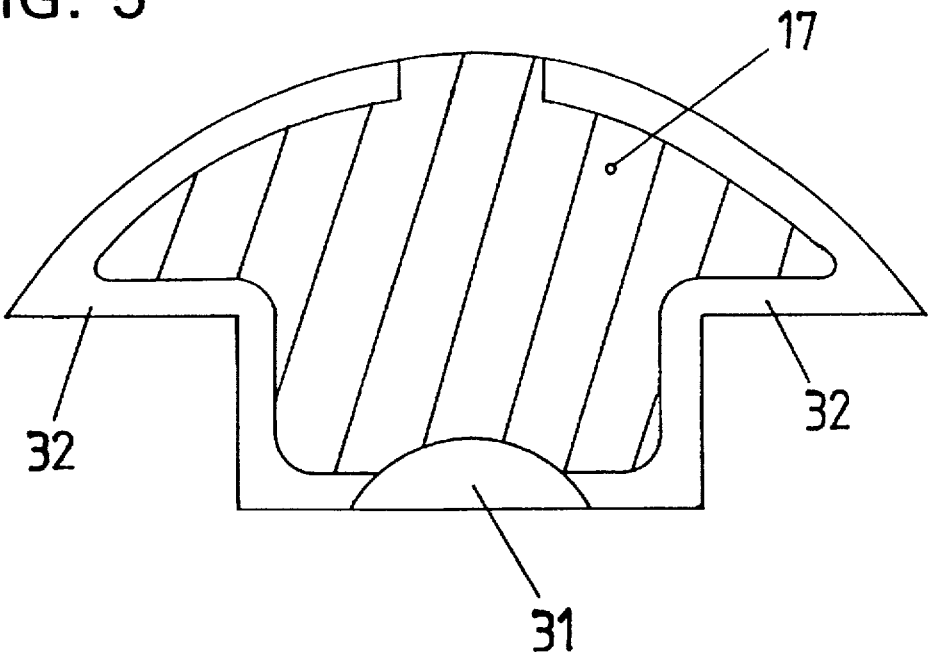
FIG. 5 shows a cross section through a supporting body with lateral bypass ducts for the air to be exhausted.

FIG. 5 shows an additional embodiment in accordance with the present invention. In the vicinity of the reverse side of the supporting body 17, which reverse side of the supporting body 17 can be used for the discharge duct 26, there can be a distribution basin 31, into which distribution basin 31, bypass grooves 32 could empty, join, or open, which bypass grooves 32 can extend starting from a lateral area of the supporting body 17 to the vicinity of the surface of the supporting body 17 facing the cover 18. It is thereby possible to achieve a sufficiently low flow resistance, even with supporting bodies 17, which supporting bodies 17 may have only a low permeability to air. If the supporting body 17 is made of foam or comparable materials, flow grooves 28 and bypass grooves 32 may be generally unnecessary.

The performance of the filter can generally be enhanced by realizing the cover 18 so that the cover 18 includes more than one layer. In particular, if the cover 18 were to be made of textile materials, it could be possible to incorporate a microfilter made of felt in the vicinity of the cover 18.

In an additional realization of the cover 18 incorporating a microfilter, the microfilter could be manufactured of a metal fiber felt, a carbon fiber felt, or a polyester felt. Various combinations of metal fiber felt, carbon fiber felt, and polyester felt can also be conceivable.

It could be conceivable, furthermore, to realize a textile felt for the microfilter as possibly being impregnated with an activated carbon material.

Additionally, the felt of the microfilter could be manufactured from a woven or non-woven fabric and from fibers not mentioned hereinabove.

In accordance with at least one preferred embodiment of the present invention, grooves 32 are embodied by separate, discrete slots being oriented generally parallel to one another.

It should be understood that the embodiments of a vacuum cleaner as described herein may be considered to correspond to a "cannister" vacuum cleaner. Particularly, it is conceivable that the apparatus shown in FIG. 1 has a suction hose which suction hose can preferably be connected to suitable attachments for removing dirt from floors and other surfaces which other surfaces can be suitably cleaned with the vacuum cleaner described herein.

One feature of the invention resides broadly in the machine, such as a portable floor cleaning machine, in particular a vacuum cleaner, with a protective bumper to damp impacts and to protect furniture and other objects, in which a protective bumper extends at least along a portion of the side walls of the machine in the circumferential direction in the form of a projecting part, characterized by the fact that the bumper 5 consists of a supporting body 17 which supporting body 17 is made of an elastic material, and that the supporting body 17 is provided with a cover 18 which cover 18 is made of a flexible material in the vicinity of its dimension which faces away from the side wall 10.

Another feature of the invention resides broadly in the machine characterized by the fact that the supporting body 17 of the bumper 5 is made of an elastically compressible material.

Yet another feature of the invention resides broadly in the machine characterized by the fact that the cover 18 is made of a textile material.

Still another feature of the invention resides broadly in the machine characterized by the fact that the supporting body 17 is made of foam.

A further feature of the invention resides broadly in the machine characterized by the fact that the bumper 5 is located in the transitional area between the top part 3 and the bottom part 4 of a housing 2.

Another feature of the invention resides broadly in the machine characterized by the fact that in the vicinity of the side walls 10, there are projections 13 which projections 13 extend in the circumferential direction, which projections 13 run essentially parallel to one another and form grooves 16 into which grooves 16 the cover 18 can be introduced and fixed in place by means of the peripheral areas of the cover 18.

Yet another feature of the invention resides broadly in the machine characterized by the fact that the projections 13 extend in a direction facing away from the interior 12 of the housing 2.

Still another feature of the invention resides broadly in the machine characterized by the fact the projections 13 extend toward the interior 12 of the housing 2.

A further feature of the invention resides broadly in the machine characterized by the fact that the cover 18, in the peripheral areas of the cover 18, has reinforcement elements 20 which reinforcement elements 20 can be introduced into corresponding grooves 16.

Another feature of the invention resides broadly in the machine characterized by the fact that the reinforcement elements 20 are made at least partly of plastic and/or cardboard.

Yet another feature of the invention resides broadly in the machine with an exhaust filter, such as a portable floor cleaning machine, in particular a vacuum cleaner, with a protective bumper 5 which protective bumper 5 extends as a projecting part at least along a portion of the side walls 10 of the machine in the circumferential direction, which bumper 5 consists of a supporting body 17 which supporting body 17 is made of an elastic material and which supporting body 17 is provided in the vicinity of its dimension facing away from the side wall 10 with an air-permeable cover 18, whereby a connection for the air to be exhausted is located in the vicinity of a dimension, side, or surface of the supporting body 17 facing away from the cover 18, and the supporting body 17 connects the connection to the cover 18 by means of at least one flow path.

Another feature of the invention resides broadly in the machine characterized by the fact that the supporting body 17 of the bumper 5 is made of an elastically compressible, air-permeable material.

Yet another feature of the invention resides broadly in the machine characterized by the fact that the cover 18 is made of a textile material.

Still another feature of the invention resides broadly in the machine characterized by the fact that the supporting body 17 is made of foam.

A further feature of the invention resides broadly in the machine characterized by the fact that the bumper 5 is located in the transitional area between the top part 3 and the bottom part 4 of a housing 2.

Another feature of the invention resides broadly in the machine characterized by the fact that in the vicinity of the side walls 10, there are projections 13 which projections 13 extend in the circumferential direction, which projections 13 run essentially parallel to one another and form grooves 16 into which grooves 16 the cover 18 can be introduced and fixed in place by means of the peripheral areas of the cover 18.

Yet another feature of the invention resides broadly in the machine characterized by the fact that the projections 13 extend in a direction facing away from the interior 12 of the housing 2.

Still another feature of the invention resides broadly in the machine characterized by the fact the projections 13 extend toward the interior 12 of the housing 2.

A further feature of the invention resides broadly in the machine characterized by the fact that the cover 18, in the peripheral areas of the cover 18, has reinforcement elements 20 which reinforcement elements 20 can be introduced into corresponding grooves 16.

Another feature of the invention resides broadly in the machine characterized by the fact that the reinforcement elements 20 are made at least partly of plastic and/or cardboard.

Yet another feature of the invention resides broadly in the machine-characterized by the fact that, starting from an exhaust duct 26 located in the vicinity of the interior 12 and continuing into the vicinity of the supporting body 17, an air duct runs through the supporting body 17 and extends into the vicinity of the cover 18.

Still another feature of the invention resides broadly in the machine characterized by the fact that in the vicinity of a surface of the supporting body 17 facing the cover 18, there are flow grooves 28 to transport the air.

A further feature of the invention resides broadly in the machine characterized by the fact that, starting from a mouth of the exhaust duct 26 in the vicinity of the supporting body 17, in a lateral area of the supporting body 17, bypass grooves 32 extend to guide the air to the vicinity of the cover 18.

Another feature of the invention resides broadly in the machine characterized by the fact that the cover 18 consists of at least two layers.

Yet another feature of the invention resides broadly in the machine characterized by the fact that at least one of the layers of the cover 18 is designed as a microfilter.

Examples of materials which may be used in bumpers and which may be utilized in accordance with the embodiments of the present invention, as set forth hereabove, can possibly be found in the following U.S. Patents: U.S. Pat. No. 5,336,708 to Chen, entitled "Gelatinous Elastomer Articles"; U.S. Pat. No. 5,236,764 to Lenz, Domas, and Haardt, entitled "Component for Absorbing Impact Energy"; U.S. Pat. No. 5,356,354 to Owens entitled "Soft, Modular, Play Equipment System for Toddlers"; and U.S. Pat. No. 5,219,933 to Henton, Naeger, and Plaver, entitled "Blends of Polycarbonate and Thermoplastic Polyurethane Resins Containing an Impact Modifier".

Examples of coverings which may be utilized in accordance with the embodiments of the present invention, as set forth hereabove, can possibly be found in the following U.S. Patents: U.S. Pat. No. 5,244,482 to Hassenboehler and Wadsworth, entitled "Post-treatment of Nonwoven Webs"; U.S. Pat. No. 5,238,536 to Danby, entitled "Multilayer Forming Fabric"; U.S. Pat. No. 5,318,831 to Hirama and Fujihira, entitled "Dust Collecting Filter Cloth"; and U.S. Pat. No. 5,269,925 to Broadhurst, entitled "Filter Comprising Multiple Layers of Non-woven Filter Fabric of Decreasing Porosity".

General examples of components relating to floor cleaning machines which may be utilized in accordance with the embodiments of the present invention, as set forth hereabove, may be found in the following U.S. Patents: U.S. Pat. No. 4,831,682 to White, entitled "Protective Cover for Floor Treating Machines"; U.S. Pat. No. 5,056,175 to Stein and Kaulig, entitled "Floor Cleaning Machine"; U.S. Pat. No. 4,955,106 to Stein and Kaulig, entitled "Upright Vacuum Cleaner"; and U.S. Pat. No. 4,993,105 to Buchtel and Bosyj, entitled "Furniture Guard with Exhaust Slots".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application Nos. P 44 32 231.3, filed on Sep. 10, 1994 and P 44 36 935.2, filed on Oct. 15, 1994, having inventors Klaus Stein and Heinz Kaulig, and DE-OS P 44 32 231.3 and P 44 36 935.2 and DE-PS P 44 32 231.3 and P 44 36 935.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A vacuum cleaner for movement along a floor, said vacuum cleaner comprising:

a housing having suction producing means;

said housing comprising a top portion, a bottom portion, and a plurality of side walls extending between said top portion and said bottom portion;

means for permitting movement of said housing along a floor;

means, extending from said housing, for conveying suction externally of said housing;

said means for conveying suction being in fluid communication with said suction producing means;

a protective bumper for protecting said housing from contact with external objects, said protective bumper being disposed on said housing;

said housing comprising at least one connection for directing exhaust air to said protective bumper; and said protective bumper comprising a porous structure being disposed to accept exhaust air from said at least one connection and exhaust the exhaust air received from said housing.

2. Machine with an exhaust filter, in particular a vacuum cleaner, with a protective bumper which extends as a projecting part at least along a portion of the side walls of the machine, which bumper comprises a supporting body which is made of an elastic material and an air permeable cover which faces away from the side wall a connection for air to be exhausted is located in the supporting body; the supporting body connects the connection to the cover by means of at least one flow path; and the supporting body of the bumper is made of an elastically compressible, air-permeable material.

3. Machine as claimed in claim 2, characterized by the fact that the cover is made of a textile material.

4. Machine as claimed in claim 3, characterized by the fact that the supporting body is made of foam.

5. Machine as claimed in claim 4, wherein said machine comprises a housing for containing a suction motor arrangement, characterized by the fact that the bumper is located in the transitional area between the top part and the bottom part of said housing.

6. Machine as claimed in claim 5, characterized by the fact that the cover, in its peripheral areas, has reinforcement elements which can be introduced into corresponding grooves.

7. Machine as claimed in claim 6, characterized by the fact that the reinforcement elements are made at least partly of at least one of plastic and cardboard.

8. Machine as claimed in claim 7 characterized by the fact that:

starting from an exhaust duct located in the interior and continuing into the supporting body, an air duct runs through the supporting body and extends into the cover; and in a surface of the supporting body facing the cover, there are flow grooves to transport the air.

9. The machine according to claim 8 wherein said cover is a microfilter and comprises at least one layer.

10. The vacuum cleaner according to claim 1 wherein said porous structure has pores and said pores generally being sized to filter particles from the exhaust air.

* * * * *

UNITED STATES PATENT AND TRADEMARK OFFICE

CERTIFICATE OF CORRECTION

PATENT NO. : 5,687,450

DATED : November 18, 1997

INVENTOR(S) : Klaus STEIN and Heinz KAULIC

It is certified that error appears in the above-identified patent and that said Letters Patent is hereby corrected as shown below:

In column 4, lines 41-42, after 'illustrated', delete "shematically" and insert --schematically--.

Signed and Sealed this

Fourteenth Day of April, 1998

Bruce Lehman

*Attest:*

BRUCE LEHMAN

*Attesting Officer*

*Commissioner of Patents and Trademarks*